US005197626A

United States Patent [19]

Bernstein

[11] Patent Number: 5,197,626

[45] Date of Patent: Mar. 30, 1993

[54] COMPARTMENTALIZED WAITER TRAY

[76] Inventor: David T. Bernstein, 1089 Oakland Trace, Atlanta, Ga. 30319

[21] Appl. No.: 907,559

[22] Filed: Jul. 2, 1992

[51] Int. Cl.[5] ..... B65D 5/26

[52] U.S. Cl. ..... 220/507; 220/555; 220/556; 206/561; 206/567; 141/98; D7/616

[58] Field of Search ..... 220/507, 509, 515, 516, 220/517, 555, 556, 737, 909, 575; 215/6; 206/557, 561, 562, 563, 564, 567, 203, 98; 141/100, 106, 237, 238, 240, 364, 365; D7/553, 554, 555, 616

[56] References Cited

U.S. PATENT DOCUMENTS

| | | | |
|---|---|---|---|
| D. 149,519 | 5/1948 | Reynolds | 220/509 X |
| 2,526,113 | 10/1950 | Blackwell | 220/509 |
| 2,685,395 | 8/1954 | Levine | 141/237 |
| 2,979,222 | 4/1961 | Levine | 206/203 X |
| 3,146,906 | 9/1964 | Swett | 206/203 |
| 3,566,929 | 3/1971 | Mead | 141/237 |
| 4,008,740 | 2/1977 | Chermack | 141/100 |
| 4,648,524 | 3/1987 | Ackermann | 220/507 |
| 4,884,683 | 12/1989 | Ford | 220/509 X |
| 4,972,886 | 11/1990 | Bernstein | 141/98 |

FOREIGN PATENT DOCUMENTS

| | | | |
|---|---|---|---|
| 1125994 | 9/1968 | United Kingdom | 220/509 |

*Primary Examiner*—Allan N. Shoap
*Assistant Examiner*—Stephen Cronin

[57] ABSTRACT

A compartmentalized waiter tray comprised of a light weight, hand carried device which functions in conjunction with a plurality of drink receptacles, or other glasses, removably retained within a plurality of compartments of an industry standard dishwashing rack to provide a quick and easy method for transporting the glasses without subsequent drink receptacle migration due to gravity and inertia and to position the drink receptacles for filling with ice or fluent drinking matter of both via automatic or semi-automatic methods; and the compartmentalized waiter tray is formed with a plurality of compartments extending above the upper surface of the tray in a pre-defined pattern to match the pre-defined pattern which the plurality of drink receptacles occupy within a plurality of compartments of the industry standard dishwashing rack; the plurality of compartments of the compartmentalized waiter tray further comprising an upper surface, internal partitions (which extend upward less than one quarter of the height of the drink receptacle and) align with the internal partitions of the industry standard dishwashing rack and are raised to a lower level than the perimeter partitions which (extend less than one half of the height of the drink receptacle and) surround the outside perimeter partitions of the industry standard dishwashing rack which align the plurality of drink receptacles with the plurality of compartments within the compartmentalized waiter tray, and a refuse bin defined by the upper surface, the raised bevelled edge, and the perimeter partitions to contain debris found within the drink receptacles after they have been used.

11 Claims, 1 Drawing Sheet

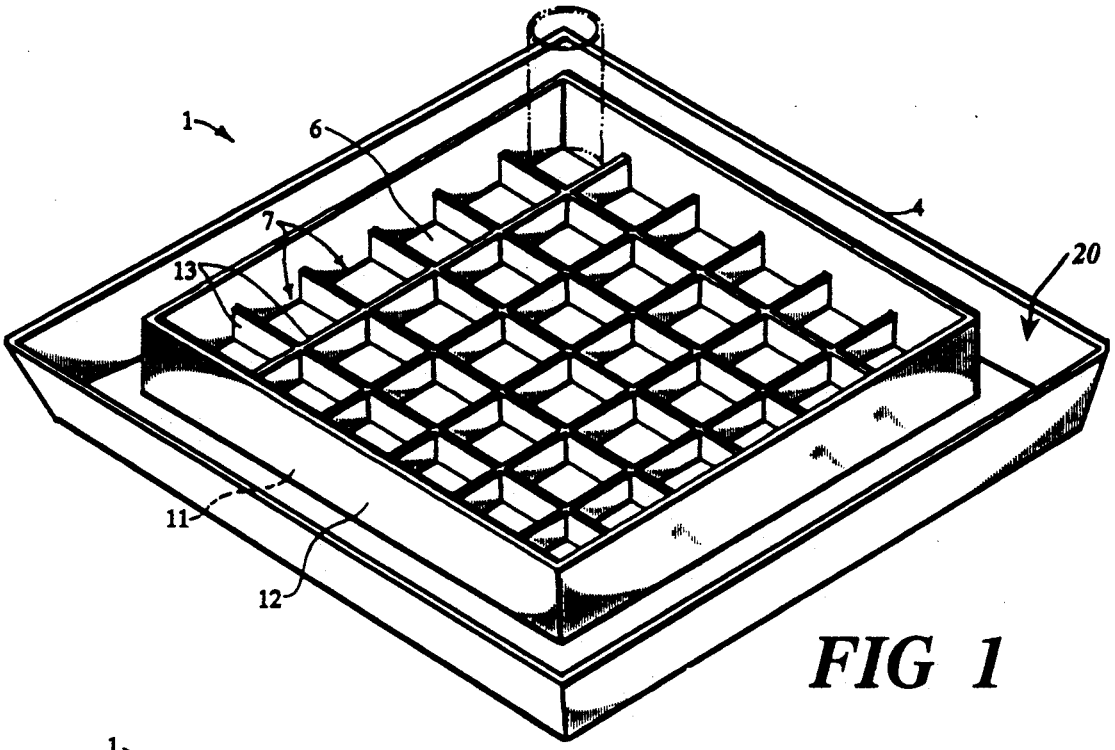
FIG 1
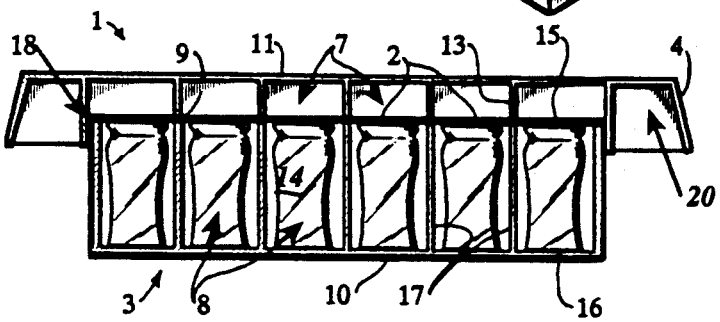
FIG 2A
FIG 2B
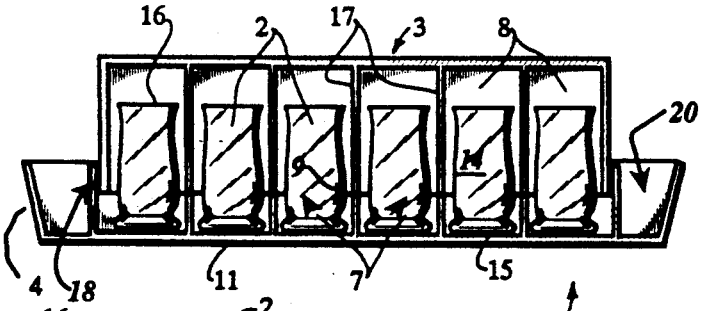
FIG 2C
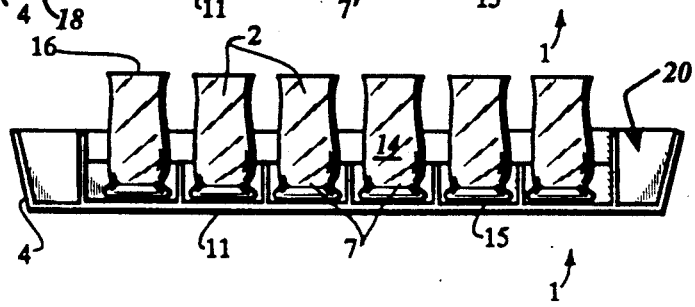

COMPARTMENTALIZED WAITER TRAY

FIELD OF THE INVENTION

This invention relates generally to the field of food service equipment and, more specifically, to equipment utilized in the distribution of ice, or fluent drinking matter, or both into drink receptacles and the transportation of drink receptacles between the dining area and the kitchen.

BACKGROUND OF THE INVENTION

Restaurants and group dining facilities provide in the course of an evening a very large number of drink receptacles of iced water or other iced drinks. There have long been recognized problems with the typical methods utilized to transport these drink receptacles from the kitchen to the dining area and then back to the kitchen as well as the methods utilized to position the drink receptacles while being filled with ice or fluent drinking matter or both via automatic or semi-automatic methods. By studying the prior art, the previously invented waiter trays are seen to be substantially flat with a raised edge encircling the flat body. While this manner of waiter tray has been the industry standard for many years, several problems have existed with relation to its embodiment for the same period. While transporting a group of drink receptacles, this older type of tray makes no provision for maintaining the drink receptacles in their intended location upon the tray. The drink receptacles are thus free to migrate to any position upon the tray as gravity and inertia cause the drink receptacles to move. Further, as drink receptacles are filled with ice or fluent drinking matter or both, their position upon the waiter tray must be kept constant so as to properly receive an ice distribution tray. Also, when loading used drink receptacles back onto the waiter tray, there is no provision made for the refuse contained in the drink receptacle to be collected in the waiter tray. As noted by studying the prior art, the previous solutions to the positioning of drink receptacles upon a waiter tray have been casual at best; with no specific provisions made to receive the drink receptacles in the pre-defined pattern defined by the industry standard dishwashing rack. U.S. Pat. No. 1,790,626 Menninger, U.S. Pat. No. 3,693,673 Oates, French Patent 79 09236 Boiron, U.S. Pat. No. 3,566,929 Mead, U.S. Pat. No. 3,732,903 Oates, U.S. Pat. No. 4,184,523 Carrigan et al, and U.S. Pat. No. 2,447,281 Schneir all contain trays which will support drink receptacles or the like. None of these devices address the supporting tray as having a pre-defined pattern which is the same as the predefined pattern of an industry standard dishwashing rack or the ability of the compartments of the supporting tray to become aligned with the plurality of compartments of the industry standard dishwashing rack so as to define a passage by which the drink receptacles may be transferred. Further, none of these devices allow for the drink receptacles to be filled with ice or fluent drinking matter or both via an ice distribution tray such as that found in U.S. Pat. No. 4,972,886 Bernstein which requires the drink receptacles to be maintained in the pre-defined pattern of the industry standard dishwashing rack while being filled.

SUMMARY OF THE INVENTION

Briefly described, the present invention comprises a rectangular, light-weight, hand carried compartmentalized waiter tray which functions in conjunction with a plurality of drink receptacles, or other drink receptacles, removably retained in an industry standard dishwashing rack which will provide a quick and easy system for positioning the plurality of drink receptacles in predetermined positions upon itself. The compartmentalized waiter tray is outfitted with a plurality of compartments formed above the top surface of the tray, which plurality of compartments are arranged in a predefined pattern to match the pattern in which the plurality of drink receptacles occupy while removably retained in the industry standard dishwashing rack. The compartmentalized waiter tray is also outfitted with a refuse bin which is used to contain debris contained within the drink receptacles after the drink receptacle has been used. Compartmentalized waiter trays, in accordance with various embodiments of the present invention, are formed in various shapes and sizes and the plurality of compartments are arranged in various predefined patterns; but always, the size, shape, and predefined pattern of the plurality of compartments cooperates with the industry standard dishwashing rack's shape and size, and the pattern defined by the plurality of compartments of the industry standard dishwashing rack.

It is therefore an object of the present invention to provide a compartmentalized waiter tray which provides for cooperation between an industry standard dishwashing rack and a plurality of drink receptacles a quick and easy process of transporting the plurality of drink receptacles and positioning the plurality of drink receptacles to receive ice or fluent drinking matter or both via an ice distribution tray.

Another object of the present invention is to provide a compartmentalized waiter tray with which a user can safely move, with no risk of falling drink receptacles, to and from the various locations found inside an eating establishment.

Another object of the present invention is to provide a compartmentalized waiter tray which contains a refuse bin which will contain debris found in the drink receptacles after the drink receptacles have been used.

Still another object of the present invention is to provide a compartmentalized waiter tray which can be stacked with or without a plurality of drink receptacles within the plurality of compartments, and washed and sanitized by conventional commercial dishwashing means.

Still other objects, features and advantages of the present invention will become apparent upon reading and understanding the specification, when taken in conjunction with the accompanying drawn figures.

BRIEF DESCRIPTION OF THE DRAWINGS

FIG. 1 is a pictorial view of a compartmentalized waiter tray showing one embodiment of the tray.

FIG. 2A is a side view of a compartmentalized waiter tray in accordance with one embodiment of the present invention, showing the tray inverted, on top of an industry standard dishwashing rack loaded with a plurality of drink receptacles.

FIG. 2B is a side view of a compartmentalized waiter tray in accordance with one embodiment of the present invention, showing the tray after receiving the plurality of drink receptacles from the industry standard dishwashing rack, now positioned on top of the tray of FIG. 2A.

FIG. 2C is a side view of a compartmentalized waiter tray in accordance with one embodiment of the present invention showing the tray loaded with a plurality of drink receptacles.

DETAILED DESCRIPTION OF THE PREFERRED EMBODIMENT

Referring now in greater detail to the drawn figures in which like numerals represent like components throughout the several views, the compartmentalized waiter tray's apparatus, FIGS. 2A, 2B, and 2C, is seen as comprising a compartmentalized waiter tray 1, a plurality of drink receptacles (or other glasses) 2, and an industry standard dishwashing rack 3. In the preferred embodiment disclosed in the accompanying drawn figures, the compartmentalized waiter tray 1 is seen as being comprised of a one piece substantially flat entity with a raised bevelled edge 4 thereabout. The plurality of compartments are raised above the tray top surface 6 and is segmented into a pre-defined pattern which might be described in the disclosed embodiment of the drawings as a six by six grid. The compartmentalized waiter tray 1 also comprises at least a bottom surface 11. The plurality of compartments 7 is further seen to comprise at least perimeter partitions 12 raised to a higher level than the internal partitions 13. Between the perimeter partitions 12 and the raised bevelled edge 4 lies the refuse bin 20.

The industry standard dishwashing rack 3 is segmented into a plurality of compartments 8 arranged in a predefined pattern. In the disclosed embodiment of the drawings, the pre-defined pattern is what might be described as a six by six grid. The industry standard dishwashing rack 3 also comprises at least a top surface 9 and a bottom surface 10. The plurality of compartments 8 is further seen to comprise at least internal partitions 17 and outside perimeter partitions 18.

Within each of either of the plurality of compartments 7 of the compartmentalized waiter tray 1 or the plurality of compartments 8 of industry standard dishwashing rack 3, a drink receptacle 2 of the plurality of drink receptacles 2 is removably retained. Each drink receptacle 2 of the plurality of drink receptacles 2 is seen as including, generally, a body portion 14, a bottom side 15, and a mouth portion 16.

It is understood that the scope of the present invention is not limited by the specifically disclosed predefined pattern of the plurality of compartments 7 of the compartmentalized waiter tray 1, the exact configuration of the plurality of compartments 8 of the industry standard dishwashing rack 3, or the overall shape of the compartmentalized waiter tray 1 as described herein.

With reference to FIG. 1, the plurality of compartments 7 is seen as being formed so as to define both the internal partitions 13 and the perimeter partitions 12 which extend above the top surface 6 of the compartmentalized waiter tray 1. In preferred embodiments, there is a raised bevelled edge which 4 slants upward and outward from the top surface 6 of the compartmentalized waiter tray 1 which raised bevelled edge 4 defines a refuse bin 20 between itself and the perimeter partition 12.

The compartmentalized waiter tray 1 is seen in FIG. 2C as having received directly, the plurality of drink receptacles 2 with each of the plurality of drink receptacles 2 positioned inside each of the plurality of compartments 7; the bottom portion 15 of each of the plurality of drink receptacles 2 seating directly upon the top surface 6 of the compartmentalized waiter tray 1. The outside perimeter partitions 12 of the plurality of compartments 7 are raised to a higher level than the internal partitions 13 of the plurality of compartments 7.

The compartmentalized waiter tray 1 is seen in FIG. 2A as resting directly upon the plurality of drink receptacles 2 and industry standard dishwashing rack 3 combination, with the internal partitions 13 of the compartmentalized waiter tray 1 in direct alignment with the corresponding internal partitions 17 of the industry standard dishwashing rack 3 and the perimeter partitions 12 of the compartmentalized waiter tray 1 surrounding the outside perimeter partitions 18 of industry standard dishwashing rack 3.

Whereas other design choices are possible within the scope of the present invention such as a 25 or 16 compartment industry standard dishwashing rack and compartmentalized waiter tray or a compartmentalized waiter tray made without a refuse bin, the specific embodiment disclosed on the accompanying drawn figures is seen as selecting a rectangular (square) comparmentalized waiter tray, a rectangular (square) plurality of compartments 7 design, a rectangular (square) plurality of compartments 8 design, and a pre-defined pattern for both pluralities of compartments 7 and 8 of a square six by six configuration.

Whereas the compartmentalized waiter tray 1 is alternately formed of various different materials, it is preferably formed of light weight molded plastic which is rigid, stackable, durable, machine washable, and acceptable by health standards for use in a commercial kitchen.

OPERATION

With the components of the compartmentalized waiter tray apparatus, FIG. 1, of the present invention described above, one method of use in accordance with the present embodiment of the present invention is described below with reference to FIGS. 2A, 2B, and 2C.

This method is taken from the compartmentalized waiter tray 1 alignment stage, FIG. 2A, through the industry standard dishwashing rack 3 emptying stage, FIG. 2B, to the final stage, FIG. 2C in which all of the drink receptacles 2 have been properly positioned within the plurality of compartments 7 of the compartmentalized waiter tray 1.

With reference to FIG. 2A, a plurality of drink receptacles 2 are removed from the dishwashing machine (not shown) where they have been maintained in a plurality of compartments 8 of industry standard dishwashing rack 3 with bottom surface 10 and top surface 9. In the industry standard dishwashing rack 3, the plurality of drink receptacles 2 are maintained with their bottom sides 15 upward and their mouth portions 16 downward. The compartmentalized waiter tray 1 is then placed upside down on the top surface 9 of the industry standard dishwashing rack 3 such that the pre-defined pattern of the plurality of compartments 7 of the compartmentalized waiter tray 1 are in alignment with the plurality of compartments 8 of industry standard dishwashing rack 3. Further, the internal partitions 13 of the plurality of compartments 7 are in alignment with the corresponding internal partitions 17 of the plurality of compartments 8 and the perimeter partitions 12 of plurality of compartments 7 surround the outside perimeter partitions 18 of industry standard dishwashing rack 3 so that both the industry standard dishwashing rack 3 and the compartmentalized waiter tray 1 are fixed in position and can not be involuntarily moved from their desired locations.

With the compartmentalized waiter tray 1 on the top surface 9 of the industry standard dishwashing rack 3 as seen in FIG. 2A, the busboy or other user then places one hand on the bottom surface 11 (now top) of the compartmentalized waiter tray 1 and the other hand on the bottom surface 10 of the industry standard dishwashing rack 3. The user then inverts the entire arrangement upside-down so that the compartmentalized waiter tray 1 is on the bottom and the industry standard dishwashing rack 3 is on the top as seen in FIG. 2B. The plurality of drink receptacles 2 are now oriented with their mouth portions 16 upward having slid down within the plurality of compartments 8 of industry standard dishwashing rack 3. The bottom sides 15 of the plurality of drink receptacles 2 are retained within the plurality of compartments 7 and resting upon the top surface 6 of compartmentalized waiter tray 1. With reference to FIG. 2C, the industry standard dishwashing rack 3 has been removed so that the mouth portions 16 of the plurality of drink receptacles 2 are exposed for filling with ice or fluent drink matter or both. The compartmentalized waiter tray 1 may then be stacked upon other compartmentalized waiter trays or delivered to the appropriate dining area where the plurality of drink receptacles 2 can be distributed (not shown). After removing the plurality of drink receptacles 2 from within the plurality of compartments 7 of the compartmentalized waiter tray 1, the cycle may be repeated with a second plurality of drink receptacles, and a second plurality of compartments of a second industry standard dishwashing rack (not shown) similar in all respects to the components illustrated in FIG. 2A.

When the drink receptacles 2 are to be returned to the kitchen, they are emptied of their debris (cigarette butts, napkins, papers, etc.) by placing the debris (not shown) into the refuse bin 20. The drink receptacles 2 are then positioned upon the compartmentalized waiter tray 1 with their bottom sides 15 retained within the plurality of compartments 7 and resting on the top of the upper surface 6 of the compartmentalized waiter tray 1 and returned to the kitchen. Once in the kitchen, an industry standard dishwashing rack 3 is placed on top of the compartmentalized waiter tray 1 as in FIG. 2B. The compartmentalized waiter tray 1, the drink receptacles 2, and the industry standard dishwashing rack 3 are then inverted so that the plurality of drink receptacles 2 become positioned within the plurality of compartments 8 of the industry standard dishwashing rack 3 as in FIG. 2A.

I claim:

1. In Combination:

a plurality of drink receptacles, each receptacle of said plurality of drink receptacle comprising at least a bottom side, a body portion defining a drink cavity and an upper edge defining a mouth for access to said drink cavity;

an industry standard dishwashing rack, comprising at least a top surface, a bottom surface, and segmented into a plurality of compartments defined by internal partitions and outside perimeter partitions, arranged in a pre-defined pattern, for removably retaining said plurality of drink receptacles, each said drink receptacle of said plurality of drink receptacles being removably retained by said industry standard dishwashing rack with said mouth oriented downward and said bottom side oriented upward;

a compartmentalized waiter tray comprising at least an upper surface, a bottom surface, a raised bevelled edge slanting upward and outward from said upper surface, a plurality of compartments defined by internal partitions and perimeter partitions, arranged in a predefined pattern for removably retaining said plurality of drink receptacles, each said drink receptacle of said plurality of drink receptacles being removably retained by said compartmentalized waiter tray with said mouth oriented for vertical access from above, and a refuse bin defined by said bevelled edge, said upper surface, and said perimeter partitions for containing debris found in said plurality of drink receptacles after said plurality of drink receptacles have been used;

wherein said upper surface of said compartmentalized waiter tray engages each said bottom side of said drink receptacle of said plurality of drink receptacles and said plurality of compartments of said compartmentalized waiter tray provides alignment means for maintaining said mouth of each said drink receptacle of said plurality of drink receptacles in alignment with the respective said compartment of said plurality of compartments of said industry standard dishwashing rack.

2. Combination of claim 1:

wherein each said compartment of said plurality of compartments of said compartmentalized waiter tray is substantially rectangular; and wherein each said compartment of said plurality of compartments of said industry standard dishwashing rack is substantially rectangular; and wherein said alignment means comprises at least said internal partitions of said plurality of compartments of said compartmentalized waiter tray being in alignment with said internal partitions of said plurality of compartments of said industry standard dishwashing rack and said perimeter partitions of said plurality of compartments of said compartmentalized waiter tray surrounding said outside perimeter partitions of said plurality of compartments of said industry standard dishwashing rack.

3. Combination of claim 1, wherein said plurality of drink receptacles is removably retained within said plurality of compartments of said industry standard dishwashing rack in a pre-defined pattern which is similar to the pre-defined pattern of said plurality of compartments of said compartmentalized waiter tray.

4. Combination of claim 3, wherein said pre-defined pattern of said plurality of compartments of said compartmentalized waiter tray is defined by said plurality of compartments being aligned in a plurality of parallel rows in the first direction and also being aligned in a plurality of parallel rows in a second direction which second direction is perpendicular to said first direction.

5. Combination of claim 4, wherein said plurality of compartments of said compartmentalized waiter tray is generally rectangular.

6. Combination of claim 1, wherein said pre-defined pattern of said plurality of compartments of said industry standard dishwashing rack is defined by said plurality of compartments being aligned in a plurality of parallel rows in the first direction and also being aligned in a plurality of parallel rows in a second direction which said second direction is perpendicular to said first direction.

7. Combination of claim 6, wherein said plurality of compartments of said industry standard dishwashing rack is generally rectangular.

8. Combination of claim 1, wherein the number of drink receptacles in said plurality of drink receptacles removably retained within said plurality of compartments of said industry standard dishwashing rack is the same as the number of compartments of said plurality of compartments of said compartmentalized waiter tray.

9. Combination of claim 2, wherein said outside perimeter partitions of said plurality of compartments of said compartmentalized waiter tray are raised from said upper surface of said compartmentalized waiter tray to a higher level than said internal partitions of said plurality of compartments from said upper surface of said compartmentalized waiter tray.

10. Combination of claim 2, further comprising:

a second plurality of drink receptacles, identical in all respects to the first said plurality of drink receptacles, each said second drink receptacle of said second plurality of drink receptacles comprising at least a bottom side, a body portion defining a drink cavity, and an upper edge defining a mouth for vertical access to said drink cavity; and a second industry standard dishwashing rack, identical in all respects to the first said industry standard dishwashing rack, for removably retaining said second plurality of drink receptacles therein, each said second drink receptacle of said second plurality of drink receptacles being removably retained within the second plurality of compartments of said second industry standard dishwashing rack with said mouth oriented downward; and a second compartmentalized waiter tray, identical in all respects to the first said compartmentalized waiter tray, for removably retaining said second plurality of drink receptacles, each said second drink receptacle of said second plurality of drink receptacles being removably retained within the second plurality of compartments of said second compartmentalized waiter tray with said mouth portion oriented for vertical access from above.

11. Combination of claim 10, wherein said compartmentalized waiter tray is movable by hand by one human user from a position in which said first plurality of drink receptacles are positioned within said plurality of compartments of said compartmentalized waiter tray from said first industry standard dishwashing rack to a position in which said first plurality of drink receptacles are removed from said plurality of compartments of said compartmentalized waiter tray to a position in which said second plurality of drink receptacles are positioned within said plurality of compartments of said compartmentalized waiter tray from said second industry standard dishwashing rack.

* * * * *

UNITED STATES PATENT AND TRADEMARK OFFICE

CERTIFICATE OF CORRECTION

PATENT NO. : 5,197,626

DATED : Mar. 30, 1993

INVENTOR(S) : David T. Bernstein

It is certified that error appears in the above-identified patent and that said Letters Patent is hereby corrected as shown below:

Abstract Correction-- Line 18 further comprising an upper surface, internal partitions which align with the internal partitions of the industry standard dishwashing rack and are raised to a lower level than the perimeter partitions which surround the outside perimeter partitions of the industry standard dishwashing rack which align the plurality of drink receptacles with the plurality of compartments within the compartmentalized waiter tray, and a refuse bin defined by the upper surface, the raised bevelled edge, and the perimeter partitions to contain debris found within the drink receptacles after they have been used.

Signed and Sealed this

Twenty-first Day of December, 1993

*Attest:*

Bruce Lehman

BRUCE LEHMAN

*Attesting Officer*

*Commissioner of Patents and Trademarks*